US012031737B2

(12) United States Patent
Shimamura

(10) Patent No.: US 12,031,737 B2
(45) Date of Patent: Jul. 9, 2024

(54) AIR CONDITIONER

(71) Applicant: FUJITSU GENERAL LIMITED, Kanagawa (JP)

(72) Inventor: Yutaka Shimamura, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 264 days.

(21) Appl. No.: 17/761,895

(22) PCT Filed: Sep. 18, 2020

(86) PCT No.: PCT/JP2020/035515
§ 371 (c)(1),
(2) Date: Mar. 18, 2022

(87) PCT Pub. No.: WO2021/084969
PCT Pub. Date: May 6, 2021

(65) Prior Publication Data

US 2022/0373208 A1 Nov. 24, 2022

(30) Foreign Application Priority Data

Oct. 31, 2019 (JP) ..... 2019-198059

(51) Int. Cl.
*F24F 11/49* (2018.01)
*F24F 11/64* (2018.01)
*F24F 110/10* (2018.01)

(52) U.S. Cl.
CPC ..... *F24F 11/49* (2018.01); *F24F 11/64* (2018.01); *F24F 2110/10* (2018.01)

(58) Field of Classification Search
CPC ..... F24F 11/49; F24F 2110/10
See application file for complete search history.

(56) References Cited

U.S. PATENT DOCUMENTS 5,277,036 A * 1/1994 Dieckmann ..... F24F 13/20 62/298

FOREIGN PATENT DOCUMENTS

JP H05-336797 A 12/1993
JP H10-047704 A 2/1998
(Continued)

OTHER PUBLICATIONS

Nov. 10, 2020, International Search Report issued for related PCT Application No. PCT/JP2020/035515.
(Continued)

*Primary Examiner* — Eric S Ruppert
(74) *Attorney, Agent, or Firm* — Paratus Law Group, PLLC

(57) ABSTRACT

An air conditioner of the present embodiment includes a heat exchanger unit in which an installation position of a suction temperature sensor can be changed and the air conditioner is capable of determining whether the installation position of the suction temperature sensor is correct. During a cooling operation, a heat exchange temperature is lower than a suction temperature, and during a heating operation, the heat exchange temperature is higher than the suction temperature. However, if a suction temperature sensor is incorrectly disposed on a downstream side of a flow of air in an indoor heat exchanger, the suction temperature detected by the suction temperature sensor is a temperature of indoor air after exchanging heat with a refrigerant in the indoor heat exchanger, so that the heat exchange temperature and the suction temperature are close to each other regardless of the cooling operation or the heating operation.

6 Claims, 3 Drawing Sheets

(56) References Cited

FOREIGN PATENT DOCUMENTS

| | | | |
|---|---|---|---|
| JP | 2008-014600 | A | 1/2008 |
| KR | 100678306 | B1 * | 2/2007 |

OTHER PUBLICATIONS

Nov. 10, 2020, International Search Opinion issued for related PCT Application No. PCT/JP2020/035515.

* cited by examiner

AIR CONDITIONER

CROSS REFERENCE TO PRIOR APPLICATION

This application is a National Stage Patent Application of PCT International Patent Application No. PCT/JP2020/035515 (filed on Sep. 18, 2020) under 35 U.S.C. § 371, which claims priority to Japanese Patent Application No. 2019-198059 (filed on Oct. 31, 2019), which are all hereby incorporated by reference in their entirety.

TECHNICAL FIELD

The present invention relates to an air conditioner, and more particularly, to an air conditioner including a duct-type indoor unit connected to a duct through which air-conditioned air conveyed into a room flows.

BACKGROUND ART

As an indoor unit of an air conditioner, there is a duct-type indoor unit in which a blower fan and a heat exchanger are disposed (for example, Patent Literature 1). The duct-type indoor unit is installed in a space on a back of a ceiling of a building, and is connected to an outdoor unit installed outdoors by a refrigerant pipe. In addition, a suction port of the duct-type indoor unit and a suction port provided on a ceiling surface of a room are connected by a suction duct, and a blowout port of the duct-type indoor unit and a blowout port provided on the ceiling surface of the room are connected by a blowout duct. In such an air conditioner having the duct-type indoor unit, indoor air is taken into a housing of the duct-type indoor unit through the suction port by driving the blower fan, and taken-in indoor air and a refrigerant circulated between the outdoor unit and the duct-type indoor unit are heated or cooled by exchanging heat in the heat exchanger of the indoor unit, and are blown into the room through the blowout port by the driving of the blower fan, thereby cooling or heating the room.

In the duct-type indoor unit as described above, there is a duct-type indoor unit in which a fan unit in which the blower fan is stored inside a housing, the heat exchanger inside the housing, and a heat exchanger unit in which a drain pan receiving condensed water generated in the heat exchanger is stored are assembled together. In such an indoor unit, for example, the heat exchanger unit is disposed on an upstream side and the fan unit is disposed on a downstream side with respect to a direction in which the taken-in indoor air flows. In this case, a suction temperature sensor that detects a temperature of the taken-in indoor air is disposed on an inflow side of the indoor air in the heat exchanger unit. In addition, the drain pan is formed in a shape, for example, an L shape, which is disposed below the heat exchanger and can receive the condensed water generated in the heat exchanger regardless of whether the heat exchanger unit is disposed vertically or horizontally.

In the air conditioner having the duct-type indoor unit formed by assembling the fan unit and the heat exchanger unit as described above, there is a case where the duct-type indoor unit is vertically disposed in an air-conditioned space, and air-conditioned air that exchanges heat with the refrigerant in the heat exchanger is blown upward or downward. Specifically, the fan unit is disposed above the heat exchanger unit, and the air-conditioned air blown out from the fan unit is blown out from a floor surface of an air-conditioned space on an upper floor of the air-conditioned space where the indoor unit is disposed through the blowout duct. Alternatively, the fan unit may be disposed below the heat exchanger unit, and the air-conditioned air blown out from the fan unit is blown through the blowout duct into a ventilation passage provided under the floor surface of the air-conditioned space, and the air-conditioned air is blown from a blowout port provided on the floor surface and communicating with the ventilation passage into the air-conditioned space.

CITATION LIST

Patent Literature

Patent Literature 1: JP-A-10-47704

SUMMARY OF INVENTION

Technical Problem

When the duct-type indoor unit is disposed vertically as described above, a vertical orientation of the heat exchanger unit at the time of installation is determined, and the heat exchanger unit cannot be installed with the vertical orientation reversed (rotated by 180°). This is because if the heat exchanger unit is vertically reversed, a positional relationship between the heat exchanger and the drain pan is vertically reversed, so that the condensed water generated in the heat exchanger cannot be received by the drain pan. Thus, when the duct-type indoor unit is disposed vertically, a direction of the heat exchanger unit is fixed, so that the inflow side of the indoor air in the heat exchanger unit is changed depending on a position of the heat exchanger unit with respect to the fan unit. Then, by changing the inflow side of the indoor air in the heat exchanger unit, a position at which the suction temperature sensor is disposed may be located on a downstream side of the heat exchanger in a flow of air inside the heat exchanger unit.

When the suction temperature sensor is on the downstream side of the heat exchanger, a temperature detected by the suction temperature sensor is the temperature of the indoor air after passing through the heat exchanger and exchanging heat with the refrigerant. At this time, various controls related to an air conditioning operation performed using a suction temperature detected by the suction temperature sensor cannot be performed normally. In order to solve such a problem, when the duct-type indoor unit is disposed vertically, the position of the suction temperature sensor may be changed according to the position of the heat exchanger unit with respect to the fan unit, that is, an operation of replacing the suction temperature sensor on the inflow side of the indoor air, which changes according to installation of the heat exchanger unit, may be performed. However, there is a risk that an operator may forget change of the position of the suction temperature sensor when installing the indoor unit, and the air conditioner capable of determining correctness of an installation position of the suction temperature sensor is desired.

The present invention solves the above-mentioned problems, and an object of the present invention is to provide an air conditioner that includes a heat exchanger unit in which an installation position of a suction temperature sensor can be changed and that is capable of determining correctness of the installation position of the suction temperature sensor.

Solution to Problem

In order to solve the above problems, an air conditioner according to the present invention includes: an indoor unit formed by communicating a first opening of a fan unit with either a third opening or a fourth opening of a heat exchanger unit, and the indoor unit includes: the fan unit including a first housing having the first opening and a second opening, and an indoor unit fan inside the first housing; the heat exchanger unit including a second housing having the third opening and the fourth opening and a heat exchanger inside the second housing; a heat exchange temperature sensor configured to detect a heat exchange temperature that is a temperature of the indoor heat exchanger; a suction temperature sensor configured to detect a suction temperature, which is a temperature of air flowing into the second housing, and selectively disposed in the vicinity of the third opening or in the vicinity of the fourth opening; and a controller configured to control the indoor fan. Then, the controller is configured to determine correctness of arrangement of the suction temperature sensor, and notify outside of a determination result of the correctness of the arrangement of the suction temperature sensor.

Advantageous Effects of Invention

In the air conditioner of the present invention as described above, in the air conditioner including the heat exchanger unit in which an installation position of the suction temperature sensor can be changed, the correctness of the installation position of the suction temperature sensor can be determined.

DESCRIPTION OF EMBODIMENTS

Hereinafter, an embodiment of the present invention will be described in detail with reference to the accompanying drawings. As the embodiment, an air conditioner in which a duct-type indoor unit is connected to an outdoor unit will be described as an example. The present invention is not limited to the following embodiment, and various modifications can be made without departing from the gist of the present invention. In a following description, the duct-type indoor unit is simply referred to as an "indoor unit" unless otherwise specified.

EXAMPLE

Figure 1A:
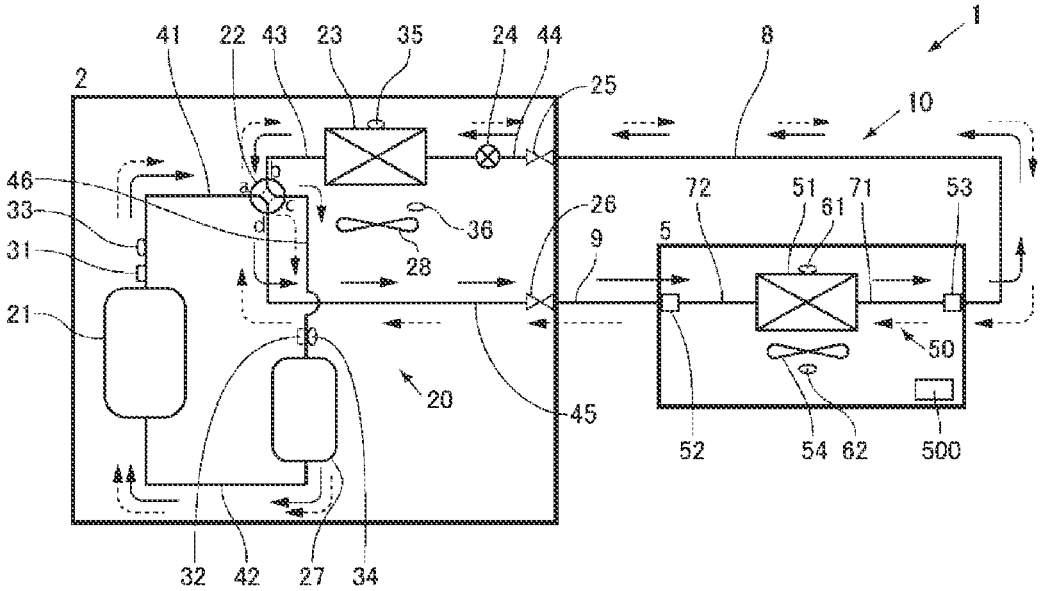
FIG. 1A is a diagram of a refrigerant circuit of an air conditioner according to an embodiment of the present invention.

As shown in FIG. 1A, an air conditioner 1 according to the present embodiment includes one outdoor unit 2, and one duct-type indoor unit 5 connected the outdoor unit 2 via a liquid pipe 8 and a gas pipe 9 in parallel. More specifically, a closing valve 25 of the outdoor unit 2 and a liquid pipe connecting portion 53 of indoor unit 5 are connected by the liquid pipe 8. In addition, a closing valve 26 of the outdoor unit 2 and a gas pipe connecting portion 52 of the indoor unit 5 are connected by the gas pipe 9. Thus, the outdoor unit 2 and the indoor unit 5 are connected by the liquid pipe 8 and the gas pipe 9 to form a refrigerant circuit 10 of the air conditioner 1.

Configuration of Outdoor Unit

First, the outdoor unit 2 will be described. The outdoor unit 2 includes a compressor 21, a four-way valve 22, an outdoor heat exchanger 23, an outdoor unit expansion valve 24, the closing valve 25 to which the liquid pipe 8 is connected, the closing valve 26 to which the gas pipe 9 is connected, an accumulator 27, and an outdoor unit fan 28. Then, these devices other than the outdoor unit fan 28 are connected to each other by refrigerant pipes described in detail below to form an outdoor unit refrigerant circuit 20 that forms a part of the refrigerant circuit 10.

The compressor 21 is a variable-capacity-type compressor that can change operation capacity by being driven by a motor (not shown) whose rotation speed is controlled by an inverter. A refrigerant discharge side of the compressor 21 is connected to a port a of the four-way valve 22, which will be described later, by a discharge pipe 41. A refrigerant suction side of the compressor 21 is connected to a refrigerant outflow side of the accumulator 27 by a suction pipe 42.

The four-way valve 22 is a valve for switching a direction in which a refrigerant flows in the refrigerant circuit 10, and includes four ports, the port a, a port b, a port c, and a port d. As described above, the port a is connected to the refrigerant discharge side of the compressor 21 by the discharge pipe 41. The port b is connected to one refrigerant port of the outdoor heat exchanger 23 by a refrigerant pipe 43. The port c is connected to a refrigerant inflow side of the accumulator 27 by a refrigerant pipe 46. Then, the port d is connected to the closing valve 26 by an outdoor unit gas pipe 45.

The outdoor heat exchanger 23 exchanges heat between the refrigerant and outside air taken into the outdoor unit 2 by rotation of the outdoor unit fan 28, which will be described later. As described above, the port b of the four-way valve 22 is connected to one refrigerant port of the outdoor heat exchanger 23 by the refrigerant pipe 43. The other refrigerant port of the outdoor heat exchanger 23 and the closing valve 25 are connected by an outdoor unit liquid pipe 44. The outdoor heat exchanger 23 functions as a condenser when the air conditioner 1 performs a cooling operation, and functions as an evaporator when the air conditioner 1 performs a heating operation.

The outdoor unit expansion valve 24 is provided in the outdoor unit liquid pipe 44. The outdoor unit expansion valve 24 is an electronic expansion valve driven by a pulse motor (not shown), and an amount of the refrigerant flowing into the outdoor heat exchanger 23 or an amount of the refrigerant flowing out of the outdoor heat exchanger 23 is adjusted by adjusting an opening degree according to the number of pulses given to the pulse motor. The opening degree of the outdoor unit expansion valve 24 is adjusted such that a discharge temperature detected by a discharge temperature sensor 33, which will be described later, becomes a predetermined target temperature.

As described above, the refrigerant inflow side of the accumulator 27 is connected to the port c of the four-way valve 22 by the refrigerant pipe 46, and the refrigerant outflow side of the accumulator 27 is connected to the refrigerant suction side of the compressor 21 by the suction pipe 42. The accumulator 27 separates the refrigerant flowing into the accumulator 27 from the refrigerant pipe 46 into a gas refrigerant and a liquid refrigerant, and causes the compressor 21 to suck only the gas refrigerant.

The outdoor unit fan 28 is formed of a resin material, and is disposed in the vicinity of the outdoor heat exchanger 23. The outdoor unit fan 28 is rotated by a fan motor (not shown), so that the outside air is taken into the outdoor unit 2 from a suction port (not shown) provided in a housing of the outdoor unit 2, and the outside air exchanging heat with the refrigerant in the outdoor heat exchanger 23 is discharged out of the outdoor unit 2 from a blowout port (not shown) provided in the housing of the outdoor unit 2.

In addition to a configuration described above, various sensors are provided in the outdoor unit 2. As shown in FIG. 1A, the discharge pipe 41 is provided with the discharge pressure sensor 31 that detects a discharge pressure, which is a pressure of the refrigerant discharged from the compressor 21, and the discharge temperature sensor 33 that detects a temperature of the refrigerant discharged from the compressor 21. In the vicinity of the refrigerant inflow port of the accumulator 27 in the refrigerant pipe 46, a suction pressure sensor 32 that detects a suction pressure which is a pressure of the refrigerant sucked into the compressor 21, and a suction temperature sensor 34 that detects a temperature of the refrigerant sucked into the compressor 21 are provided.

The outdoor heat exchanger 23 is provided with a heat exchange temperature sensor 35 that detects a temperature of the outdoor heat exchanger 23. An outside air temperature sensor 36 that detects a temperature of the outside air flowing into the outdoor unit 2, that is, an outside air temperature, is provided in the vicinity of the suction port (not shown) of the outdoor unit 2.

In addition, the outdoor unit 2 is provided with an outdoor unit controller (not shown). The outdoor unit controller periodically (for example, every 30 seconds) takes in detection values of various sensors. In addition, a signal including operation information transmitted from the indoor unit 5 is input to the outdoor unit controller. The outdoor unit controller adjusts the opening degree of the outdoor unit expansion valve 24 and performs drive control over the compressor 21 and the outdoor unit fan 28 based on various kinds of information obtained.

Configuration of Indoor Unit

Next, the indoor unit 5 will be described with reference to FIGS. 1 and 2. The indoor unit 5 of the present embodiment is the duct-type indoor unit, and includes an indoor unit fan 54 inside a housing 5*a*3 of a fan unit 5*a* shown in FIG. 2. In addition, the indoor unit 5 includes an indoor heat exchanger 51 inside a housing 5*b*3 of a heat exchanger unit 5*b* shown in FIG. 2, the gas pipe connecting portion 52, the liquid pipe connecting portion 53, and an indoor unit controller 500 shown in FIG. 1. The above-described components other than the indoor unit fan 54 and the indoor unit controller 500 are connected to each other by refrigerant pipes described in detail below to form an indoor unit refrigerant circuit 50 that forms a part of the refrigerant circuit 10.

Figure 2A:
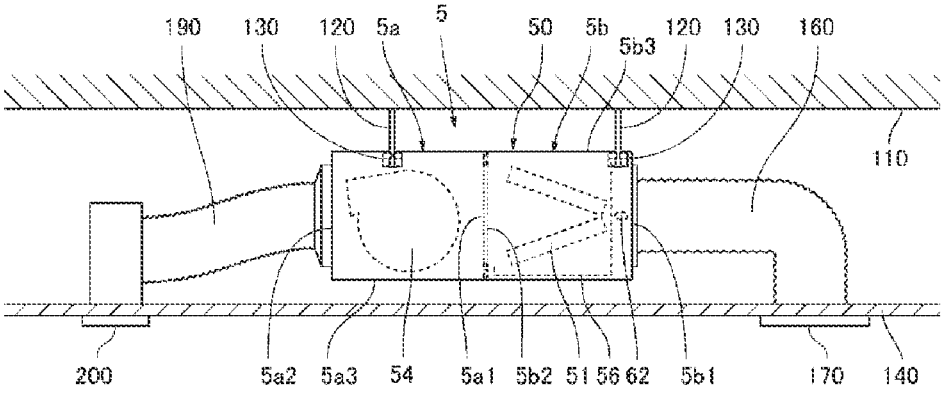
FIG. 2A is a diagram of an installation pattern of an indoor unit in the air conditioner according to the embodiment of the present invention, and shows a case where the indoor unit is disposed on a back of a ceiling.

As shown in FIG. 2A, the fan unit 5*a* has the housing 5*a*3 (corresponding to a first housing of the present invention) formed in a rectangular parallelepiped shape using a sheet metal or a resin material, and includes the indoor unit fan 54 as described above inside the housing 5*a*3. The fan unit 5*a* is provided with a first opening 5*a*1 and a second opening 5*a*2 that allow inside and outside of the housing 5*a*3 to communicate with each other. The first opening 5*a*1 and the second opening 5*a*2 are provided on opposing surfaces of the housing 5*a*3, and the indoor unit fan 54 is disposed inside the housing 5*a*3 such that a blowout port of the indoor unit fan 54 is desired in the second opening 5*a*2.

As shown in FIG. 2A, the heat exchanger unit 5*b* has a housing 5*b*3 (corresponding to a second housing of the present invention) formed in the rectangular parallelepiped shape using the sheet metal or the resin material, and includes the indoor heat exchanger 51 as described above inside the housing 5*b*3, the gas pipe connecting portion 52, the liquid pipe connecting portion 53, and the indoor unit controller 500. The heat exchanger unit 5*b* is provided with a third opening 5*b*1 and a fourth opening 5*b*2 that allow inside and outside of the housing 5*b*3 to communicate with each other. The third opening 5*b*1 and the fourth opening 5*b*2 are provided on opposing surfaces of the housing 5*b*3. In addition, the heat exchanger unit 5*b* is provided with a drain pan 56 formed in a substantially L-shape. The drain pan 56 is formed in the substantially L-shape so as to be able to receive condensed water generated in the indoor heat exchanger 51 when the heat exchange unit 5*b* is installed such that the third opening 5*b*1 faces a right side (an arrangement side of a suction duct 160) in FIG. 2A and when the heat exchange unit 5*b* is installed such that the third opening 5*b*1 faces a lower side (an indoor ceiling 140 side) in FIG. 2A.

Figure 2B:
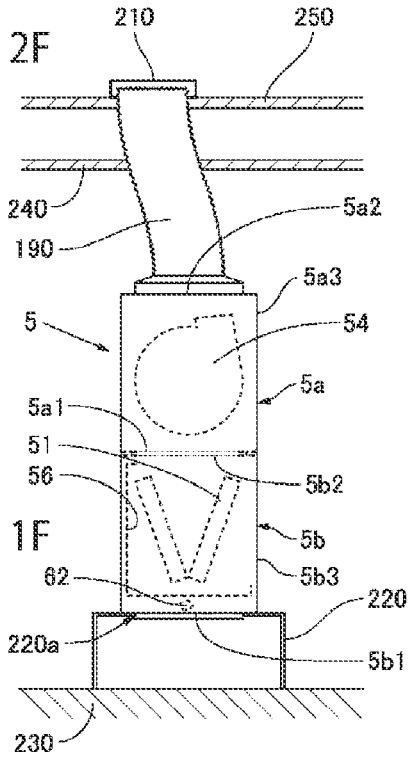
FIG. 2B is a diagram of the installation pattern of the indoor unit in the air conditioner according to the embodiment of the present invention, and shows a case where the indoor unit is disposed on a floor and air-conditioned air is blown out to an upper floor.
Figure 2C:
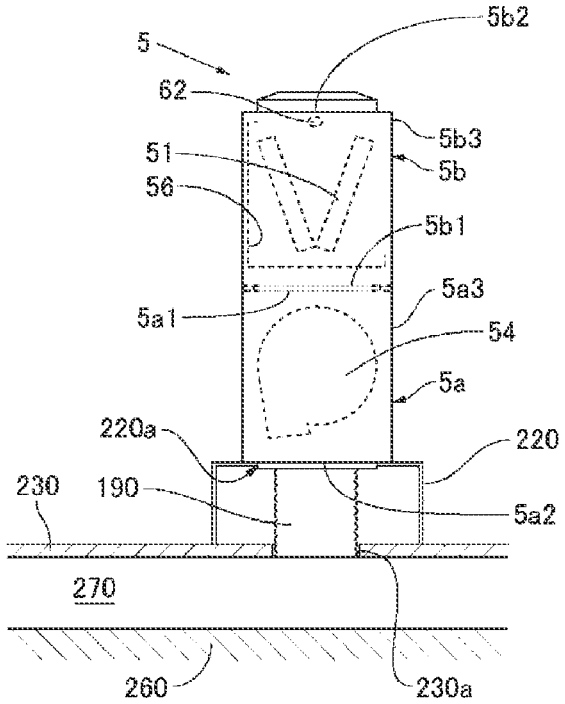
FIG. 2C is a diagram of the installation pattern of the indoor unit in the air conditioner according to the embodiment of the present invention, and shows a case where the indoor unit is disposed on the floor and the air-conditioned air is blown into a ventilation passage under the floor.

Next, devices and members that form the indoor unit 5 will be described. The indoor heat exchanger 51 is provided to exchange heat between the refrigerant and indoor air taken into the indoor unit 5 from a suction port (not shown) by rotation of the indoor unit fan 54, which will be described later, and has a bent shape as shown in FIGS. 2A to 2C. A shape of the indoor heat exchanger 51 shown in FIGS. 2A to 2C is merely an example, and the shape of the indoor heat exchanger 51 is not limited thereto. As shown in FIG. 1A, an indoor unit liquid pipe 71 connects one refrigerant port of the indoor heat exchanger 51 to the liquid pipe connecting portion 53, and an indoor unit gas pipe 72 connects the other refrigerant port and the gas pipe connecting portion 52. The indoor heat exchanger 51 functions as the evaporator when the air conditioner 1 performs the cooling operation, and functions as the condenser when the air conditioner 1 performs the heating operation. The liquid pipe connecting portion 53 and the gas pipe connecting portion 52 are connected to the refrigerant pipes by welding, flare nuts, or the like.

The indoor unit fan 54 is a sirocco fan, and includes a cylindrical impeller (not shown) having a large number of blades inside a casing formed of the resin material in a spiral shape, and a fan motor (not shown) connected to a motor shaft connected to a center of the impeller. The indoor unit fan 54 takes in the indoor air through the third opening 5*b*1 or the fourth opening 5*b*2 inside the housing 5*b*3 of the heat exchanger unit 5*b* by rotation of the impeller by the fan motor, and discharges the indoor air, which exchanges heat with the refrigerant in the indoor heat exchanger 51, into a room through the second opening 5*a*2 of the fan unit 5*a*.

In addition to a configuration described above, various sensors are provided in the indoor unit 5. As shown in FIG. 1A, the indoor heat exchanger 51 is provided with a heat exchange temperature sensor 61 that detects a temperature of the indoor heat exchanger 51. As shown in FIG. 2, a suction temperature sensor 62 that detects a temperature of the indoor air flowing into the heat exchanger unit 5*b* is provided on a suction side of the indoor air in the heat exchanger unit 5*b*. As will be described in detail later, an installation position of the suction temperature sensor 62 can be changed by disposing the heat exchange unit 5*b* when the indoor unit 5 is disposed vertically.

Figure 1B:
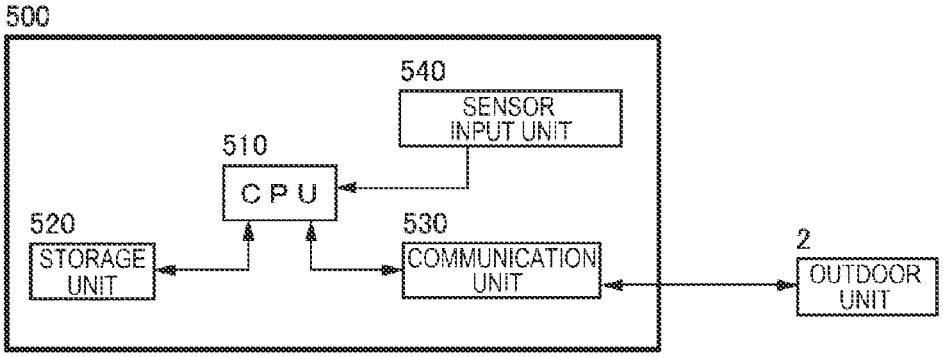
FIG. 1B is a functional block diagram of an indoor unit controller of an air-conditioning apparatus according to the embodiment of the present invention.

The indoor unit controller 500 is mounted on a control board stored in an electrical component box (not shown) provided inside the housing 5*b*3 of the heat exchanger unit 5*b*. As shown in FIG. 1B, the indoor unit controller 500 includes a CPU 510, a storage unit 520, a communication unit 530, and a sensor input unit 540.

The storage unit 520 is configured with, for example, a flash memory, and stores a control program of the indoor unit 5, detection values corresponding to detection signals from various sensors, a control state of an indoor fan 55, and the like. The communication unit 530 is an interface for communicating with the outdoor unit 2 or a remote controller (not shown) operated by a user. The sensor input unit 540 takes in detection results of various sensors of the indoor unit 5 and outputs the detection results to the CPU 510.

The CPU 510 takes in the detection results of the sensors of the indoor unit 5 described above via the sensor input unit 540. In addition, the CPU 510 takes in an operation information signal including an operation mode (cooling operation/dehumidifying operation/heating operation), an air volume, and the like transmitted from the remote controller (not shown) operated by the user via the communication unit 530. The CPU 510 performs drive control over the indoor unit fan 54, determination of the installation position of the suction temperature sensor 62, which will be described later, and the like, based on a taken-in detection result and operation information signal.

Installation State of Indoor Unit

The indoor unit 5 described above can be installed horizontally as shown in FIG. or can be installed vertically as shown in FIG. 2B or 2C. Then, when the indoor unit 5 is disposed vertically shown in FIG. 2B or 2C, a positional relationship between the fan unit 5*a* and the heat exchanger unit 5*b* is different between a case where the air-conditioned air that exchanges heat with the refrigerant in the indoor heat exchanger 51 is blown upward (a state shown in FIG. 2B) and a case where the air-conditioned air is blown downward (a state shown in FIG. 2C).

Hereinafter, the installation state of the indoor unit 5 will be described with reference to FIGS. 2A to 2C in an order of horizontal installation, vertical installation (upward blowing), and vertical installation (downward blowing).

Horizontal Installation

When the indoor unit 5 is installed horizontally, for example, as shown in FIG. 2A, the indoor unit 5 is installed in a space between a building ceiling surface 110 and an indoor ceiling surface 140. The fan unit 5*a* and the heat exchanger unit 5*b* are installed horizontally, the first opening 5*a*1 of the fan unit 5*a* and the fourth opening 5*b*2 of the heat exchanger unit 5*b* are connected, and the housing 5*a*3 of the fan unit 5*a* and the housing 5*b*3 of the heat exchanger unit 5*b* communicate with each other. The second opening 5*a*2 of the fan unit 5*a* is connected to a blowout grill 200 provided on the indoor ceiling surface 140 via, a blowout duct 190, and the third opening 5*b*1 of the heat exchanger unit 5*b* is connected to a suction grill 170 provided on the indoor ceiling surface 140 via the suction duct 160. A combination of the fan unit 5*a* and the heat exchanger unit 5*b* is suspended from the building ceiling surface 110 with a plurality of suspension bolts 120 fixed to the building ceiling surface 110 at one end, and is installed in a space between the building ceiling surface 110 and the indoor ceiling surface 140.

When the indoor unit 5 horizontally installed operates, the indoor air taken from the suction grill 170 via the suction duct 160 and the third opening 5*b*1 into the housing 5*b*3 of the heat exchanger unit 5*b* by driving of the indoor unit fan 54 exchanges heat with the refrigerant in the indoor heat exchanger 51. The indoor air that exchanges heat with the refrigerant in the indoor heat exchanger 51 flows from the fourth opening 5*b*2 of the heat exchanger unit 5*b* through the first opening 5*a*1 of the fan unit 5*a* into the housing 5*a*3 of the fan unit 5*a*, and is discharged via the second opening 5*a*2 of the fan unit 5*a* and the blowout duct 190 from the blowout grill 200 into the room.

Vertical Installation 1 (Upward Blowing)

When the indoor unit 5 is installed vertically and the air-conditioned air is blown out upward, for example, as shown in FIG. 2B, the indoor unit 5 is installed on a first floor floor surface 230 in a two-story building using a pedestal 220. At this time, the heat exchanger unit 5*b* is disposed on the pedestal 220, and the fan unit 5*a* is disposed on the heat exchanger unit 5*b* so that the first opening 5*a*1 of the fan unit 5*a* and the fourth opening 5*b*2 of the heat exchanger unit 5*b* face each other. Accordingly, the first opening 5*a*1 of the fan unit 5*a* and the fourth opening 5*b*2 of the heat exchanger unit 5*b* are connected, and the housing 5*a*3 of the fan unit 5*a* and the housing 5*b*3 of the heat exchanger unit 5*b* communicate with each other. The second opening 5*a*2 of the fan unit 5*a* is connected to a blowout grill 210 provided on a second floor floor surface 250 via the blowout duct 190. The blowout duct 190 is connected to the blowout grill 210 through a first floor ceiling surface 240. In addition, the third opening 5*b*1 of the heat exchanger unit 5*b* is opened toward the first floor floor surface 230 via a hole 220*a* provided in the pedestal 220, and the indoor air is taken via a communication hole (not shown) provided in the pedestal 220 from the third opening 5*b*1 into the heat exchanger unit 5*b*.

When the indoor unit 5 installed vertically and blowing out the air-conditioned air upwards operates, the indoor air taken via the third opening 5*b*1 into the housing 5*b*3 of the heat exchanger unit 5*b* by the driving of the indoor unit fan 54 exchanges heat with the refrigerant in the indoor heat exchanger 51. The indoor air that exchanges heat with the refrigerant in the indoor heat exchanger 51 flows from the fourth opening 5*b*2 of the heat exchanger unit 5*b* via the first opening 5*a*1 of the fan unit 5*a* into the housing 5*a*3 of the fan unit 5*a*, and is discharged via the second opening 5*a*2 of the fan unit 5*a* and the blowout duct 190 from the blowout grill 210 provided on the second floor floor surface 250 into the room.

Vertical Installation 2 (Downward Blowing)

When the indoor unit 5 is installed vertically and the air-conditioned air is blown out downward, for example, for example, as shown in FIG. 2C, the indoor unit 5 is installed on the first floor floor surface 230 using the pedestal 220, and more specifically, the indoor unit 5 is installed above a floor surface opening 230*a* communicating with a ventilation passage 270 of the air-conditioned air provided between the first floor floor surface 230 and a foundation surface 260. At this time, the fan unit 5*a* is disposed on the pedestal 220, and the heat exchanger unit 5*b* is disposed on the fan unit 5*a* so that the first opening 5*a*1 of the fan unit 5*a* and the third opening 5*b*1 of the heat exchanger unit 5*b* face each other. Accordingly, the first opening 5*a*1 of the fan unit 5*a* and the third opening 5*b*1 of the heat exchanger unit 5*b* are connected, and the housing 5*a*3 of the fan unit 5*a* and the housing 5*b*3 of the heat exchanger unit 5*b* communicate with each other. The second opening 5*a*2 of the fan unit 5*a* is connected to the floor surface opening 230*a* of the first floor floor surface 230 via, the hole 220*a* of the pedestal 220 by the blowout duct 190. The fourth opening 5*b*2 of the heat exchanger unit 5*b* opens toward an upper side of the air-conditioned space.

When the indoor unit 5 installed vertically and blowing out the air-conditioned air downwards operates, the indoor air taken via the fourth opening 5*b*2 into the housing 5*b*3 of the heat exchanger unit 5*b* by the driving of the indoor unit fan 54 exchanges heat with the refrigerant in the indoor heat exchanger 51, The indoor air that exchanges heat with the refrigerant in the indoor heat exchanger 51 flows from the third opening 5*b*1 of the heat exchanger unit 5*b* via the first opening 5*a*1 of the fan unit 5*a* into the housing 5*a*3 of the fan unit 5*a*, and is discharged through the second opening 5*a*2 of the fan unit 5*a*, the blowout duct 190, and the floor surface opening 230*a* of the first floor floor surface 230 into the ventilation passage 270. The air-conditioned air flowing through the ventilation passage 270 is discharged from a blowout hole (not shown) provided in the first floor floor surface 230 into the air-conditioned space.

Operation of Refrigerant Circuit

Next, a flow of the refrigerant and an operation of each part in the refrigerant circuit 10 during the air conditioning operation of the air conditioner 1 according to the present embodiment will be described with reference to FIG. 1A. In a following description, first, a case where the air conditioner 1 performs the heating operation will be described, and next, a case where the air conditioner 1 performs the cooling operation will be described. Solid arrows in FIG. 1A indicate the flow of the refrigerant during the heating operation. Dashed arrows in FIG. 1A indicate the flow of the refrigerant during the cooling operation.

Heating Operation

As shown in FIG. 1A, when the air conditioner 1 performs the heating operation, the four-way valve 22 is in a state indicated by solid lines, that is, the four-way valve 22 is switched so that the port a and the port d communicate with each other and the port b and the port c communicate with each other. Accordingly, the refrigerant circuit 10 serves as a heating cycle in which the indoor heat exchanger 51 functions as the condenser, and the outdoor heat exchanger 23 functions as the evaporator.

When the compressor 21 is driven in a state where the refrigerant circuit 10 is in the heating cycle, the refrigerant discharged from the compressor 21 flows through the discharge pipe 41 into the four-way valve 22, flows from the four-way valve 22 through the outdoor unit gas pipe 45, and flows via the closing valve 26 into the gas pipe 9.

The refrigerant flowing through the gas pipe 9 flows via the gas pipe connecting portion 52 into the indoor unit 5. The refrigerant flowing into the indoor unit 5 flows through the indoor unit gas pipe 72 and flows into the indoor heat exchanger 51. The refrigerant flowing into the indoor heat exchanger 51 exchanges heat with the indoor air taken into the housing 5*b*3 of the heat exchanger unit 5*b* by the rotation of the indoor unit fan 54, and condenses.

Thus, the indoor heat exchanger 51 functions as the condenser, and the indoor air heated by exchanging heat with the refrigerant in the indoor heat exchanger 51 is blown out from the second opening 5*a*2 of the fan unit 5*a* into the air-conditioned space, thereby heating the air-conditioned space in which the indoor unit 5 is installed.

The refrigerant flowing from the indoor heat exchanger 51 into the indoor unit liquid pipe 71 flows out from the indoor unit liquid pipe 71 via the liquid pipe connecting portion 53 to the liquid pipe 8. The refrigerant flowing through the liquid pipe 8 and flowing via the closing valve 25 into the outdoor unit 2 flows through the outdoor unit liquid pipe 44, and is decompressed when passing through the outdoor unit expansion valve 24. The refrigerant decompressed by the outdoor unit expansion valve 24 flows through the outdoor unit liquid pipe 44 and flows into the outdoor heat exchanger 23, exchanges heat with the outside air taken into the outdoor unit 2 by the rotation of the outdoor unit fan 28, and evaporates. The refrigerant flowing from the outdoor heat exchanger 23 into the refrigerant pipe 43 flows in an order of the four-way valve 22, the refrigerant pipe 46, the accumulator 27, and the suction pipe 42, is sucked into the compressor 21, and is compressed again.

Cooling Operation

As shown in FIG. 1A, when the air conditioner 1 performs the cooling operation, the four-way valve 22 is in a state indicated by broken lines, that is, the four-way valve 22 is switched so that the port a and the port b communicate with each other and the port c and the port d communicate with each other. Accordingly, the refrigerant circuit 10 serves as the cooling cycle in which the indoor heat exchanger 51 functions as the evaporator, and the outdoor heat exchanger 23 functions as the condenser.

When the compressor 21 is driven in a state where the refrigerant circuit 10 is in the cooling cycle, the refrigerant discharged from the compressor 21 flows through the discharge pipe 41 into the four-way valve 22, and flows from the four-way valve 22 via the refrigerant pipe 43 into the outdoor heat exchanger 23. The refrigerant flowing into the outdoor heat exchanger 23 exchanges heat with the outside air taken into the outdoor unit 2 by the rotation of the outdoor unit fan 28, and condenses. The refrigerant flowing out of the outdoor heat exchanger 23 to the outdoor unit liquid pipe 44 passes through the outdoor unit expansion valve 24 whose opening degree is fully opened, and flows via the closing valve 25 out to the liquid pipe 8.

The refrigerant flowing through the liquid pipe 8 flows via the liquid pipe connecting portion 53 into the indoor unit 5. The refrigerant flowing into the indoor unit 5 flows through the indoor unit liquid pipe 71 and flows from the indoor unit liquid pipe 71 into the indoor heat exchanger 51. The refrigerant flowing into the indoor heat exchanger 51 exchanges heat with the indoor air taken into the housing 5*b*3 of the heat exchanger unit 5*b* by the rotation of the indoor unit fan 54, and evaporates.

Thus, the indoor heat exchanger 51 functions as the evaporator, and the indoor air cooled by exchanging heat with the refrigerant in the indoor heat exchanger 51 is blown out from the second opening 5*a*2 of the fan unit 5*a* into the air-conditioned space, thereby cooling the room in which the indoor unit 5 is installed.

The refrigerant flowing out of the indoor heat exchanger 51 to the indoor unit gas pipe 72 flows through the gas pipe connecting portion 52 out to the gas pipe 9. The refrigerant flowing through the gas pipe 9 and the closing valve 26 into the outdoor unit 2 flows in an order of the outdoor unit gas pipe 45, the four-way valve 22, the refrigerant pipe 46, the accumulator 27, and the suction pipe 42, is sucked into the compressor 21, and is compressed again.

Arrangement of Suction Temperature Sensor

When the air conditioner 1 performs the heating operation or the cooling operation described above, the compressor 21, the expansion valve 24, the outdoor unit fan 28, and the indoor unit fan 54 are controlled so that the suction temperature (a temperature of the air-conditioned space: room temperature) detected by the suction temperature sensor 62 provided in the heat exchanger unit 5*b* of the indoor unit 5 becomes a set temperature that is a target temperature of the air conditioning operation set by the user. Alternatively, when the air conditioner 1 performs the heating operation or the cooling operation, by comparing the suction temperature detected by the suction temperature sensor 62 with the temperature of the indoor heat exchanger 51 detected by the heat exchange temperature sensor 61, it is confirmed whether operations of the four-way valve 22 and the expansion valve 24 are normal.

As described above, since the suction temperature detected by the suction temperature sensor 62 is used for various controls and operation confirmation, it is necessary to dispose the suction temperature sensor 62 at a position where the suction temperature can be accurately detected. As described above, the indoor unit 5 of the present embodiment can be installed in three states of the horizontal installation, the vertical installation (upward blowing), and the vertical installation (downward blowing), the position where the suction temperature sensor 62 is disposed is different among cases of the horizontal installation or the vertical installation (upward blowing), and the vertical installation (downward blowing).

Specifically, as shown in FIGS. 2A and 2B, when the indoor unit 5 is installed horizontally or installed vertically (upward blowing), the suction temperature sensor 62 is disposed between the third opening 5*b*1 and the indoor heat exchanger 51 of the heat exchanger unit 5*b*. This is because the indoor air is taken from the third opening 5*b*1 into the heat exchanger unit 5*b* when the indoor unit 5 is installed horizontally or installed vertically (upward blowing).

In contrast, as shown in FIG. 2C, when the indoor unit 5 is installed vertically (downward blowing), the suction temperature sensor 62 is disposed between the fourth opening 5*b*2 and the indoor heat exchanger 51 of the heat exchanger unit 5*b*. This is because the indoor air is taken from the fourth opening 5*b*2 into the heat exchanger unit 5*b* when the indoor unit 5 is installed vertically (downward blowing).

The indoor unit 5 of the present embodiment is either shipped by connecting the fan unit 5*a* and the heat exchanger unit 5*b* as shown in FIGS. 2A and 2B at the time of factory shipment, or shipped by connecting the fan unit 5*a* and the heat exchanger unit 5*b* as shown in FIG. 2C and it is necessary to determine arrangement of the suction temperature sensor 62 depending on which connection state is to be shipped.

When the indoor unit 5 is installed in an installation place, the indoor unit 5 is installed in a state in which the user selects one of the horizontal installation, the vertical installation (upward blowing), and the vertical installation (downward blowing). At this time, when the positional relationship between the fan unit 5*a* and the heat exchanger unit 5*b* at the time of shipment is changed in order to match a selected installation state, it is necessary to replace the installation position of the suction temperature sensor 62. For example, when the indoor unit 5 is installed in the installation place vertically (downward blowing), when the suction temperature sensor 62 at the time of shipment is disposed between the third opening 5*b*1 and the indoor heat exchanger 51 of the heat exchanger unit 5*b* shown in FIGS. 2A and 2B, it is necessary to replace the suction temperature sensor 62 between the fourth opening 5*b*2 and the indoor heat exchanger 51 of the heat exchanger unit 5*b* shown in FIG. 2C.

However, there is a risk that the operator of the installation may forget the replacement of the suction temperature sensor 62, which is required by replacing the positional relationship between the fan unit 5*a* and the heat exchanger unit 5*b* when installing the indoor unit 5.

Figure 3:
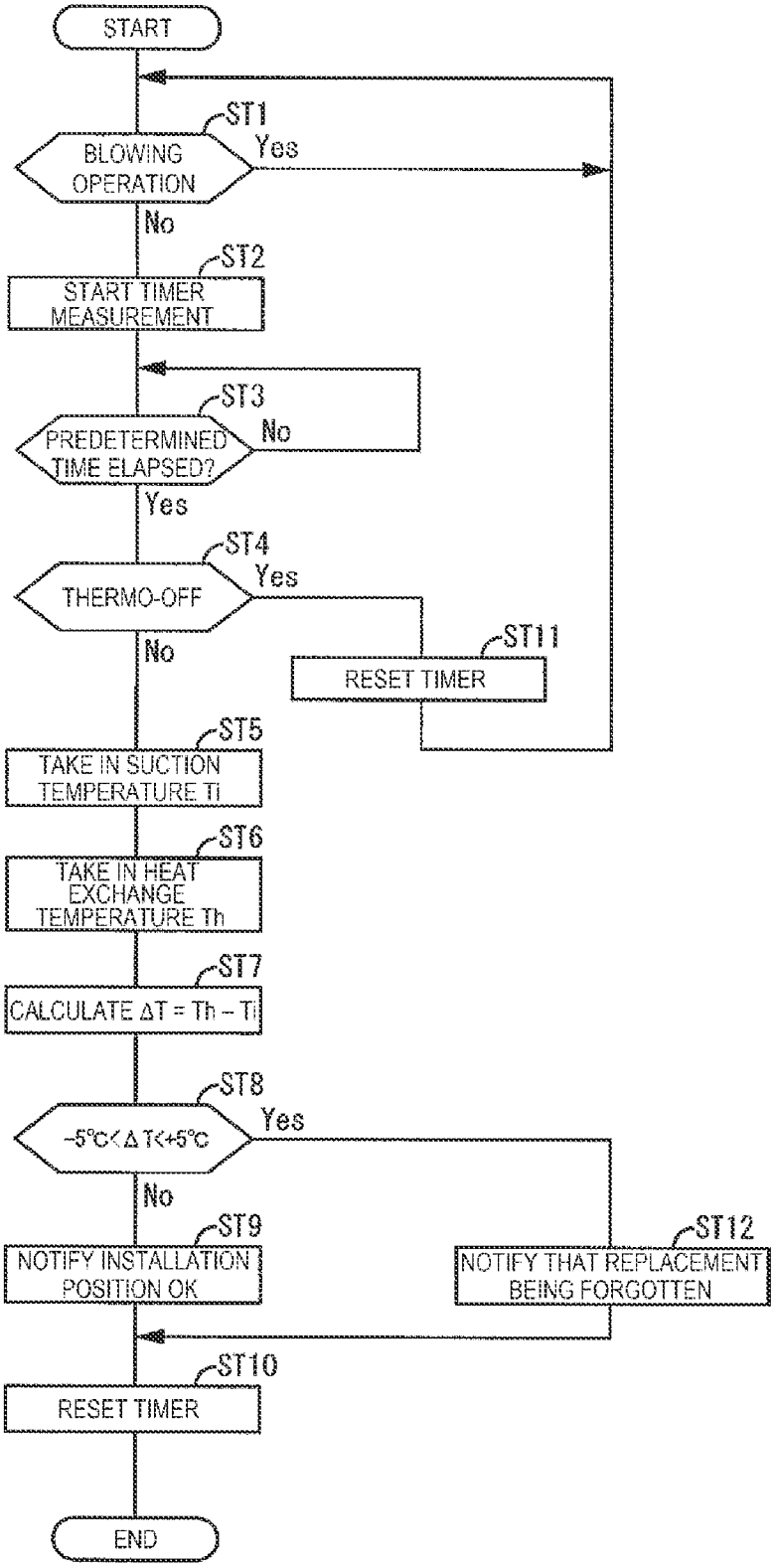
FIG. 3 is a flowchart related to a processing when the indoor unit controller performs correctness determination of a position of a suction temperature sensor.

Therefore, in the air conditioner 1 of the present embodiment, when a test operation is performed after the installation of the air conditioner 1, a processing described below is automatically performed using a flowchart shown in FIG. 3. Specifically, during the test operation of the indoor unit 5, the suction temperature detected by the suction temperature sensor 62 and the temperature of the indoor heat exchanger 51 detected by the heat exchange temperature sensor 61 (hereinafter, referred to as heat exchange temperature) are detected, and correctness of the installation position of the suction temperature sensor 62 is determined using these temperatures. When the installation position of the suction temperature sensor 62 is incorrect, for example, a display unit of the remote controller (not shown) that operates the indoor unit 5 is notified that the installation position of the suction temperature sensor 62 is incorrect.

Processing Related to Correctness Determination of Installation Position of Suction Temperature Sensor Here, with reference to FIG. 3, a processing when the CPU 510 of the indoor unit controller 500 determines whether the installation position of the suction temperature sensor 62 is correct after installation of the air conditioner 1 will be described. In FIG. 3, ST indicates a step of the processing, and a subsequent number indicates the number of the step. In a following description, the suction temperature is Ti (unit: ° C.), the heat exchange temperature is Th (unit: ° C.), and a temperature difference obtained by subtracting the suction temperature Ti from the heat exchange temperature Th is ΔT (unit: ° C.).

After the air conditioner 1 is installed, when a signal for starting the test operation is input to the CPU 510 of the indoor unit controller 500 by an operation of the remote controller or the like by the operator, the test operation of the air conditioner 1 is started. The CPU 510 determines whether a current operation mode of the indoor unit 5 is a blowing operation (ST1). In the correctness determination of the installation position of the suction temperature sensor 62 in the present embodiment, since the temperature difference ΔT between the heat exchange temperature Th when the refrigerant flows in the indoor heat exchanger 51 and the suction temperature Ti is small, that is, the suction temperature sensor 62 is disposed on a downstream side of the flow of the air in the indoor heat exchanger 51, it is determined that the installation position of the suction temperature sensor 62 is incorrect when the suction temperature Ti becomes a value close to the heat exchange temperature Th by exchanging heat with the refrigerant in the indoor heat exchanger 51. Therefore, in the blowing operation in which the refrigerant does not flow in the indoor heat exchanger 51, it is not possible to determine whether the installation position of the suction temperature sensor 62 is correct, and thus determination of ST1 is performed.

If the current operation mode of the indoor unit 5 is the blowing operation (ST1: Yes), the CPU 510 returns the processing to ST1. At this time, the CPU 510 may notify the remote controller (not show) of the indoor unit 5 or a portable terminal used by the operator so as to switch the operation mode from the blowing operation to the cooling operation or the heating operation.

If the current operation mode of the indoor unit 5 is not the blowing operation (ST1: No), that is, if the current operation mode of the indoor unit 5 is the cooling operation or the heating operation in which the refrigerant flows in the indoor heat exchanger 51, the CPU 510 starts timer measurement (ST2). Although not shown, the CPU 510 includes a timekeeping unit.

Next, the CPU 510 determines whether a predetermined time elapses since the start of the timer measurement in ST2 (ST3). The predetermined time here is a time determined by performing a test or the like in advance, and is a time required for the heat exchange temperature Th to reach a constant temperature due to the inflowing refrigerant. For example, the predetermined time is 10 minutes.

If the predetermined time does not elapse (ST3: No), the CPU 510 returns the processing to ST3 and continues the timer measurement. If the predetermined time elapses (ST3: Yes), the CPU 510 determines whether the indoor unit 5 in a so-called thereto-off state in which the suction temperature becomes close to the set temperature (for example, set temperature ±1° C.) and the indoor unit fan 54 is stopped (ST4). When the indoor unit 5 is in the thermo-off state, the refrigerant does not flow through the indoor heat exchanger 51 similarly as in a case of the blowing operation described above, and the correctness of the installation position of the suction temperature sensor 62 cannot be determined, and thus the determination of ST4 is performed.

If the indoor unit 5 is in the thereto-off state (ST4: Yes), the CPU 510 resets a timer (ST11), and returns the processing to ST1, that is, stops the correctness determination of the installation position of the suction temperature sensor 62.

If the indoor unit 5 is not in the thereto-off state (ST4: No), the CPU 510 takes in the suction temperature Ti (ST5), and takes in the heat exchange temperature Th (ST6). The suction temperature Ti is detected by the suction temperature sensor 62, the heat exchange temperature Th is detected by the heat exchange temperature sensor 61, and the CPU 510 takes in the suction temperature Ti and the heat exchange temperature Th periodically (for example, every 30 seconds) via the sensor input unit 540 and stores the suction temperature Ti and the heat exchange temperature Th in the storage unit 520. In the processing of ST6, the CPU 510 reads a latest value among the suction temperature Ti and the heat exchange temperature Th stored in the storage unit 520.

Next, the CPU 510 uses the suction temperature Ti taken in in ST5 and the heat exchange temperature Th taken in ST6 to calculate the temperature difference ΔT obtained by subtracting the suction temperature Ti from the heat exchange temperature Th (ST7). When the operation mode of the indoor unit 5 is the cooling operation, since the heat exchange temperature Th is lower than the suction temperature Ti (during the cooling operation, the refrigerant having a temperature lower than the suction temperature Ti flows through the indoor heat exchanger 51), the temperature difference ΔT is a negative value. When the operation mode of the indoor unit 5 is the heating operation, since the heat exchange temperature Th is higher than the suction temperature Ti (during the heating operation, the refrigerant having a temperature higher than the suction temperature Ti flows through the indoor heat exchanger 51), the temperature difference ΔT is a positive value.

Next, the CPU 510 determines whether the temperature difference ΔT calculated in ST7 is higher than −5° C. and lower than +5° C. (ST8), that is, whether the temperature difference ΔT is within a predetermined range. As described above, during the cooling operation, the heat exchange temperature Th is lower than the suction temperature Ti, and during the heating operation, the heat exchange temperature Th is higher than the suction temperature Ti. However, if the suction temperature sensor 62 is incorrectly disposed on the downstream side of the flow of air in the indoor heat exchanger 51, the suction temperature Ti detected by the suction temperature sensor 62 is the temperature of the indoor air after exchanging heat with the refrigerant in the indoor heat exchanger 51, so that the suction temperature Ti is close to the heat exchange temperature Th regardless of the cooling operation or the heating operation.

In the present embodiment, attention is focused on the relationship between the heat exchange temperature Th and the suction temperature Ti when the suction temperature sensor 62 is disposed incorrectly, and when the temperature difference ΔT is higher than −5° C. and lower than +5° C., it is determined that the heat exchange temperature Th and the suction temperature Ti are close to each other, that is, the suction temperature sensor 62 is incorrectly disposed on the downstream side of the flow of air in the indoor heat exchanger 51. The predetermined range of the temperature difference ΔT used in the above-mentioned determination is −5° C. to +5° C., as an example, and an optimum value may be set for each air conditioner by performing a test or the like in advance.

If the temperature difference ΔT is not higher than −5° C. and lower than +5° C. (ST8: No), that is, when the suction temperature sensor 62 is disposed at a correct position, the CPU 510 notifies that the installation position of the suction temperature sensor 62 is correct (installation position OK) (ST9), and the processing proceeds to ST10. If the temperature difference ΔT is higher than −5° C. and lower than +5° C., (ST8: Yes), that is, when the suction temperature sensor 62 is not disposed at the correct position, the CPU 510 notifies that replacement of the suction temperature sensor 62 is forgotten (ST12), and the processing proceeds to ST10. Here, the notification of the installation position of the suction temperature sensor 62 being OK or the notification of replacement of the suction temperature sensor 62 being forgotten may be notified to the above remote controller (not shown) of the indoor unit 5 or the portable terminal used by the operator, and may be displayed on the display unit of the remote controller or the portable terminal to indicate that replacement of the suction temperature sensor 62 is forgotten. The remote controller and the portable terminal correspond to an external device of the present invention.

The CPU 510 that ends the processing of ST9 or the processing of ST12 resets the timer (ST10), and ends the processing related to the correctness determination of the installation position of the suction temperature sensor 62.

As described above, in the air conditioner 1 of the present embodiment, in the test operation performed after the installation of the air conditioner 1, it is determined whether the suction temperature sensor 62 is disposed at the correct position (the position where the temperature of the indoor air before exchanging heat with the refrigerant in the indoor heat exchanger 51 can be detected) by using the taken-in heat exchange temperature Th and suction temperature Ti, and when the suction temperature sensor 62 is disposed at an incorrect position, the notification is performed. Accordingly, when the air conditioner 1 is installed, the operator can notice that the replacement of position of the suction temperature sensor 62 in the housing of the heat exchanger unit 5*b* according to the installation state of the indoor unit 5 is forgotten, and the suction temperature sensor 62 can be disposed at an appropriate position.

In the embodiment described above, a case is described in which, when the test operation of the air conditioner 1 is started by the operator after the installation of the air conditioner 1, the CPU 510 of the indoor unit controller 500 starts the correctness determination of the installation position of the suction temperature sensor 62, that is, when the operator instructs the test operation, the correctness determination of the installation position of the suction temperature sensor 62 is automatically started. However, the present invention is not limited to this, and for example, an operation unit that instructs to perform the correctness determination of the installation position of the suction temperature sensor 62 may be provided in the indoor unit 5, the remote controller, the portable terminal, or the like, and the correctness determination of the installation position of the suction temperature sensor 62 may be executed when the operator operates the operation unit.

Although the present invention is described in detail with reference to a specific embodiment, it is obvious to those skilled in the art that various changes and modifications can be made without departing from the spirit and scope of the present invention.

REFERENCE SIGNS LIST

1 air conditioner
2 outdoor unit
5 indoor unit
5*a* fan unit
5*a*1 first opening
5*a*2 second opening
5*a*3 housing
5*b* heat exchanger unit
5*b*1 third opening
5*b*2 fourth opening
5*b*3 housing
51 indoor heat exchanger
54 indoor unit fan
56 drain pan
61 heat exchange temperature sensor
62 suction temperature sensor
500 indoor unit controller
510 CPU
Ti suction temperature
Th heat exchange temperature
ΔT temperature difference

The invention claimed is:

1. An air conditioner comprising:

an indoor unit formed by communicating a first opening of a fan unit with either a third opening or a fourth opening of a heat exchanger unit, the indoor unit including:

the fan unit including a first housing having the first opening and a second opening, and an indoor unit fan inside the first housing;

the heat exchanger unit including a second housing having the third opening and the fourth opening and an indoor heat exchanger inside the second housing;

a heat exchange temperature sensor configured to detect a heat exchange temperature that is a temperature of the indoor heat exchanger;

a suction temperature sensor configured to detect a suction temperature, which is a temperature of air flowing into the second housing, and selectively disposed in the vicinity of the third opening or in the vicinity of the fourth opening; and a controller configured to control the indoor fan, wherein the controller is configured to determine correctness of arrangement of the suction temperature sensor, and notify a user of a determination result of the correctness of the arrangement of the suction temperature sensor.

2. The air conditioner according to claim 1, wherein the controller is further configured to determine whether the arrangement of the suction temperature sensor is correct by using a temperature difference between the heat exchange temperature detected by the heat exchange temperature sensor and the suction temperature detected by the suction temperature sensor.

3. The air conditioner according to claim 2, wherein the controller is further configured to determine that the suction temperature sensor is disposed at an incorrect position when the temperature difference is within a predetermined range.

4. The air conditioner according to claim 1, wherein correctness determination of the arrangement of the suction temperature sensor is executed during a test operation of the air conditioner.

5. The air conditioner according to claim 2, wherein correctness determination of the arrangement of the suction temperature sensor is executed during a test operation of the air conditioner.

6. The air conditioner according to claim 3, wherein correctness determination of the arrangement of the suction temperature sensor is executed during a test operation of the air conditioner.

* * * * *